United States Patent [19]

Hawley, Jr.

[11] Patent Number: 5,060,938

[45] Date of Patent: Oct. 29, 1991

[54] ROPE CLIMBING EXERCISE APPARATUS

[76] Inventor: Peter J. Hawley, Jr., 35 Valley Path, Marshfield, Mass. 02050

[21] Appl. No.: 609,476

[22] Filed: Nov. 5, 1990

[51] Int. Cl.[5] ..... A63B 7/04

[52] U.S. Cl. ..... 272/112; 272/132; 272/118

[58] Field of Search ..... 272/112, 118, 131, 109, 272/132; 248/364

[56] References Cited

U.S. PATENT DOCUMENTS

| | | | |
|---|---|---|---|
| 3,445,108 | 5/1969 | Fenner et al. | 272/60 |
| 3,599,974 | 8/1971 | Price | 272/132 |
| 3,782,718 | 1/1974 | Saylor | 273/60 |
| 3,794,316 | 2/1974 | Toman | 272/60 |
| 4,199,139 | 4/1980 | Mahnke et al. | 272/118 |
| 4,512,570 | 4/1985 | Tardivel | 272/112 |
| 4,775,146 | 10/1988 | Stankovic | 272/118 |

FOREIGN PATENT DOCUMENTS

| | | |
|---|---|---|
| 5223423 | 2/1977 | Japan . |
| 1204219 | 2/1969 | U.S.S.R. . |

*Primary Examiner*—Richard J. Apley
*Assistant Examiner*—L. Thomas
*Attorney, Agent, or Firm*—Cesari and McKenna

[57] ABSTRACT

Rope climbing apparatus comprises a support, a length of rope and a rope accumulator supported by the support for storing a variable length of rope. The accumulator includes a dancer and means for force-loading the dancer to a maximum storage position. A segment of rope is presented to a user of the apparatus so that he can draw rope from the accumulator. Variable drag mechanism supported by the support feeds rope pulled by the user back to the accumulator to replenish the accumulator. The drag mechanism inhibits the feeding of rope to the accumulator unless the rope is pulled with a force sufficient to overcome the force-loading on the accumulator dancer and move the dancer from its maximum storage position. The drag mechanism also controls the rate at which rope is fed to the accumulator in accordance with the magnitude of the accumulator dancer force loading.

10 Claims, 1 Drawing Sheet

ROPE CLIMBING EXERCISE APPARATUS

This invention relates to exercise apparatus. It relates more particularly to such apparatus that enables the user to simulate climbing a rope.

BACKGROUND OF THE INVENTION

Rope climbing is a very effective form of exercise because it maintains the climber's arm and back muscles under dynamic tension. In other words, the climber's muscles are subjected to a pulling force due to part or all of the climber's weight as he supports himself on the rope whether or not he is moving up or down on the rope. Superimposed on that force is an acceleration component which manifests itself when the climber pulls himself up or lowers himself down on the rope. Placing one's body under dynamic tension of this type improves one's muscle tone, blood circulation, respiration and general mental and physical fitness.

Rope climbing may be practiced as an exercise in and of itself or as part of training for mountain or rock climbing.

There have been some efforts to make exercise machines to simulate the act of climbing a rope. Usually these machines require the user to pull down on a rope hand-over-hand, with the rope passing through some kind of friction or drag mechanism that offers resistance to the pulling motion. One example of such exercise apparatus is disclosed in U.S. Pat. No. 4,512,570. The trouble with this type of apparatus is that it really does not simulate accurately the act of rope climbing which, as noted previously, subjects the arms to dynamic tension whether or not the climber is moving up or down on the rope. In the existing rope climbing exercise machines of which I am aware, no attempt is made to simulate the effect of the user's weight. In other words, no opposing force is exerted on the rope unless the user is actually accelerating the rope. Therefore, the user's muscles are not maintained under more or less constant tension as he pulls down on the rope, hand over hand. Rather, the force exerted on each arm varies from some maximum value at the top of each pulling motion to near zero at the bottom of the stroke. Such variable or intermittent tensioning of the body muscles is not as effective as constant dynamic tension in conditioning the body.

Also, prior exercise machines of this general type have tended to be fairly large and complicated pieces of machinery which take up a large amount of floor space and are relatively expensive to make.

SUMMARY OF THE INVENTION

Accordingly, the present invention aims to provide exercise apparatus which more closely simulates the activity of rope climbing than do prior machines of this general type.

Another object of the invention is to provide a rope climbing exercise machine which can exert a more or less constant opposing force on one's body when one uses the machine.

A further object of the invention is to provide rope climbing exercise apparatus which is adjustable to accommodate users whose strengths vary over a relatively wide range.

Another object of the invention is to provide exercise apparatus of this general type which is relatively compact and which requires a relatively small amount of floor space.

Still another object of the invention is to provide rope climbing exercise apparatus which is composed of relatively few components which are easy and inexpensive to fabricate.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my exercise apparatus comprises an upstanding frame which supports a system of pulleys around which the rope is trained to form an endless loop. The loop includes a vertical stretch of rope situated at one end of the frame which one can grasp and pull down in hand over hand fashion to simulate climbing the rope. Preferably, a seat is located adjacent to that end of the frame on which the user may sit while he or she is exercising.

The apparatus includes a rope accumulator in the form of a pair of fixed pulleys rotatably mounted to the frame and a force-loaded movable dancer pulley around which the rope is looped so that the accumulator can store a variable length of rope. The dancer pulley is urged to its maximum storage position by a stack of weights which normally rests on one end of a generally horizontal teeterboard pivotally mounted to the frame. The teeterboard is more than balanced by a spring acting between the opposite end of the teeterboard and the frame. When the user pulls down on the vertical stretch of rope, rope is drawn from the accumulator. The rope at the bottom of the stretch being pulled is recirculated back into the accumulator by way of a variable drag mechanism.

The drag mechanism includes a relatively large diameter circular drum or wheel which is rotatively supported by the frame directly above the spring end of the teeterboard. The drum or wheel has three circumferential grooves so that it constitutes in effect three pulleys which rotate in unison. The rope at the bottom of the stretch being pulled by the user is conducted to one of these grooves so that a segment of the rope is trained around the drum on its way back to the accumulator. A second one of the drum grooves accommodates a non-extensible strap whose ends extend from the drum and are secured to the spring end of the teeterboard. This strap exerts a constant frictional braking force on the drum which is proportional to the amount of weight lifted from the teeterboard by the accumulator dancer when the user pulls down on the rope while performing a rope climbing exercise. The greater the downward force on the rope and the amount of weight lifted from the teeterboard, the greater the drag exerted on the drum.

The third groove in the drum accommodates a second inextensible strap that is engaged around the drum. One end of that second strap is connected to the apparatus frame at a location below the spring end of the teeterboard. The other end of that belt is connected to a lever arm, one end of which is pivotally mounted to the frame so that the arm can swing toward and away from the drum. The opposite or free end of that lever arm is linked to the accumulator dancer pulley so that when the dancer pulley is moved from its maximum toward its minimum storage position, the lever arm is swung about its pivot to reduce the tension on the second strap trained around the rotary drum, and vice versa. This change in strap tension varies the drag exerted on the drum by the second strap. The coefficient of friction of the second strap and the tension exerted on that strap through the lever arm are selected so that the drum will not turn unless the dancer pulley is moved from its maximum storage position by the user pulling on the rope.

Before he starts to exercise, the user selects the amount of weight to be lifted by the dancer pulley when he pulls down on the vertical rope segment. Then he starts pulling the rope down hand-over-hand. Assuming that he pulls with enough force to lift the selected amount of weight from the teeterboard, the dancer will move from its maximum storage position and, in so doing, move the lever arm to untension the second strap thereby allowing the drag mechanism, i.e. the drum, to recirculate rope to replenish the accumulator. The rate at which the drum turns will depend upon the rate at which the user advances the rope. That, in turn, depends on the force exerted by the user pulling on the rope.

As will be seen presently, the accumulator and variable drag mechanism combine to oppose the pulling force on the rope in such a way that the user feels as he would if he were actually climbing the rope. In other words, the forces exerted on the user's arm and back muscles via the rope are more or less the same as would be exerted if the user were supporting part or all of his own weight while handing from a rope or moving up or down on the rope. The exercise apparatus thus provides a much more effective and realistic climbing experience than is provided by comparable conventional machines of this general type which exert intermittent or variable drag forces on the rope to oppose the hand-over-hand downward pulling motions of the user.

As will be seen presently, my exercise apparatus is composed of relatively few simple parts that are easy to fabricate and to assemble. Moreover, the apparatus is quite compact so that it can fit easily in a relatively small exercise room or space. Therefore, the apparatus should be a welcome addition to any gym, health club or the like.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENT

Figure 1:
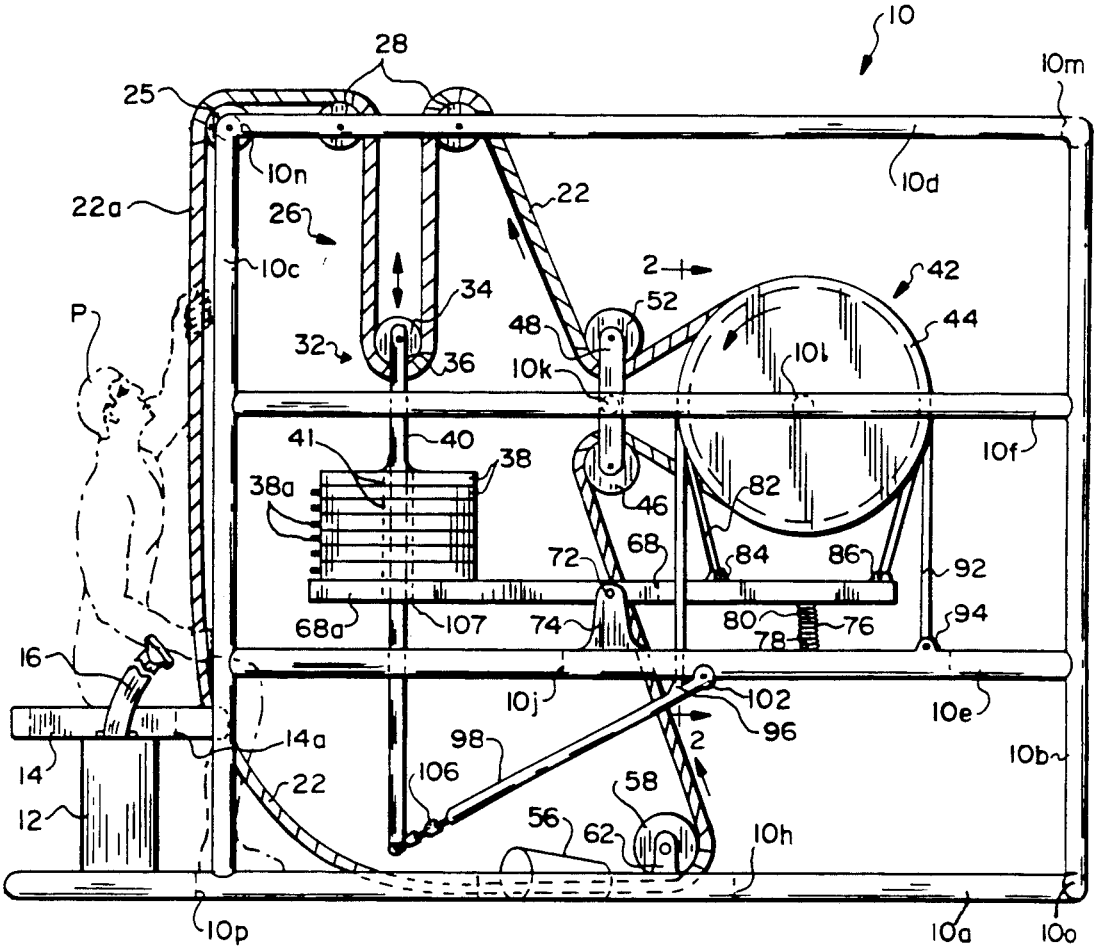
FIG. 1 is a diagrammatic view of rope climbing exercise apparatus incorporating my invention.

Referring to FIG. 1 of the drawing, my exercise apparatus includes a support or frame 10 comprising a pair of upstanding side-by-side, generally rectangular frames, each frame including a horizontal bottom frame member 10*a*, a pair of vertical front and rear frame members 10*b* and 10*c* and a top horizontal frame member 10*d*. Additional intermediate horizontal frame members 10*e* and 10*f* extend between the front and rear frame members 10*b* and 10*c* to provide reinforcement and support sites for the various apparatus components to be described presently.

The two side frames are maintained in spaced-apart relation by a lateral strap 10*h* connected between bottom frame members 10*a* and another lateral strap 10*j* extending between frame members 10*e*. There are also lateral tubular frame members 10*k* and 10*l* extending between frame members 10*f*. Additional lateral frame members 10*m* and 10*n* extend between frame members 10*d* at the upper corners of frame 10.

Preferably the bottom frame members 10*a* extend beyond the rear frame members 10*c*, with the ends of those frames being connected by a lateral strap 10*p* which supports a pedestal 12 and a seat 14 mounted to the top of the pedestal. When using the apparatus, one may sit on the seat 14 facing frame 10 as shown at P in FIG. 1. Preferably, the seat includes a seat belt 16 to enable one to secure himself to the seat to maximize the amount of rope pulling force that can be exerted when exercising.

The part of the apparatus that is acted upon directly by the user P is a length of strong rope 22 formed as an endless loop in a generally vertical plane within the apparatus frame 10. The rope includes a stretch or segment 22*a* which extends down vertically just in front of seat 14 from a pulley 25 rotatively mounted between frame members 10*d* at the upper left corner of frame 10. Preferably the seat has a notch 14*a* at its forward end to provide clearance for the rope segment 22*a* so that segment can pass close to the chest of the user P sitting on seat 14 as shown in FIG. 1.

When the user pulls down on the rope segment 22*a*, rope is drawn over pulley 25 from a rope accumulator shown generally at 26. That accumulator comprises a pair of spaced-apart fixed pulleys 28 rotatively mounted between the frame top members 10*d* and a vertically movable dancer trolley 32. suspended below the fixed pulleys. The dancer includes a pulley 34 rotatively mounted between the legs of a generally U-shaped strap 36. Dancer 32 is force-loaded downward by a stack of weights or biasing means 38, the uppermost weight 38 being connected to a rod 40 whose upper end is connected to the bridge portion of the strap 36. The rod 40 extends downward through central holes 41 in the weights so that its lower end is located well below the weight stack. Preferably, each of the weights 38 weighs approximately the same amount and is of the lockable variety found in many conventional exercise machines. That is, each weight 38 and the weights include locking mechanisms so that they can be locked together using the levers or pins 38*a* projecting from the edges of the weights. Thus, by actuating the lever 38*a* on a selected one of the weights, all of the weights below the selected one will be released. Alternatively, graduated weights in which each successive weight 38 weighs more than the one above it may be used.

As will be apparent from the foregoing, if dancer 32 is raised, the uppermost weight 38 permanently connected to rod 40 will be raised along with the dancer, as will all of the underlying weights 38 locked to that weight. For example, if the lever 38*a* on that uppermost weight 38 is moved to its unlocking position, only that uppermost, and presumably the lightest, weight will be raised when the dancer 32 moves upwards.

Rope 22 passes over the stationary pulleys 28 and under the dancer pulley 34 so that the accumulator can store a variable length or quantity of rope, the amount of which varies depending upon the vertical position of the dancer 32. That is, as the dancer moves upwards, less rope is stored in the accumulator 26. Conversely, when the dancer is near the bottom of its vertical motion, the accumulator 26 contains a greater quantity of rope. The vertical position of the dancer 32 may vary within a range from its maximum storage position (as shown in FIG. 1) to a position of equilibrium, as described below.

Figure 2:
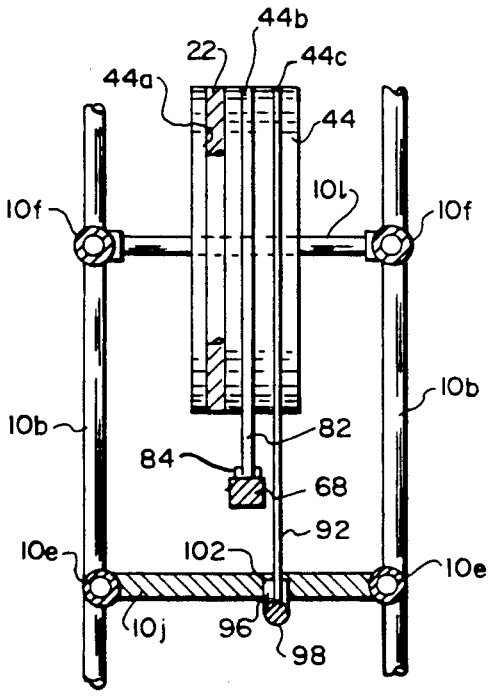
FIG. 2 is a sectional view taken along line 2—2 of FIG. 1.

Mechanism 42 comprises a relatively large diameter drum or wheel 44 rotatively mounted to transverse frame member 10*l*. As best seen in FIG. 2, drum 44 is formed with three peripheral grooves 44*a*, 44*b* and 44*c* spaced apart axially along the drum. Thus, the drum is equivalent, in effect, to three axially-connected together pulleys. Rope 22 is guided into the leftmost drum groove 44*a* by a guide pulley 46 rotatively connected between the lower ends of a pair of vertical straps 48 mounted to the frame transverse frame member 10*k*. The rope 22 is guided from the drum groove 44*a* to the nearest fixed pulley 28 of accumulator 26 by guide pulley 52 rotatively mounted between the upper ends of straps 48.

When the user pulls down on the rope segment 22*a*, the tension on the rope tends to turn the drum 44 counterclockwise as viewed in FIG. 1 so that rope is drawn onto the drum by way of the guide pulley 46. That rope requirement is satisfied by rope which accumulates at the bottom of the loop and which is guided by a conical guide 56 mounted to the transverse strap 10*h* onto a guide pulley 58 rotatively mounted to an ear 62 projecting up from strap 10*h*. Pulley 58 redirects the rope to the guide pulley 46 so that the rope being pulled by user P forms a continuous loop as it passes through the accumulator 26 and drag mechanism 42.

Still referring to FIG. 1, positioned directly under accumulator 26, guide pulleys 46 and 52 and drum 44 is a teeterboard 68. The teeterboard is connected by pivots 72 at its transverse centerline between a pair of laterally spaced-apart tabs 74 projecting up from the frame transverse strap 10*j*. Preferably, pivots 74 are located more or less directly below the pivotal connections of the guide pulleys 46 and 52 to strap 48. The rear or lefthand end segment of teeterboard 68 has an enlargement 68*a* whose areal extent is comparable to that of weights 38 so that the stack of weights can rest on enlargement 68*a* where it tends to tilt the teeterboard counterclockwise as viewed in FIG. 1. The downward force of the weights 38 on the teeterboard is offset by a strong spring 76 connected between an eye 78 on the frame transverse strap 10*j* and an eye 80 near the opposite end of the teeterboard, preferably at a location thereon directly below the pivot axis of drum 44. Preferably, the spring 76 acts to maintain the frictional braking force applied to the drum 44 by belt 82 proportional to the weight lifted from the stack of weights 38.

As shown in FIGS. 1 and 2, an inextensible belt or strap 82 is engaged around drum 44 in its middle groove 44*b* with the opposite ends of that strap being connected to the teeterboard 68 by eye connections 84 and 86 spaced equally therealong from the spring eye 80. Thus it will be appreciated that when the teeterboard 68 is tilted clockwise as viewed in FIG. 1 due to the force applied by spring 76 and a reduced weight on the teeterboard enlargement 68*a*, the tension on belt 82 will be increased so that the belt applies increased frictional drag to drum 44. Conversely, if the teeterboard 68 tilts counterclockwise in response to a greater weight on its enlargement 68*a*, the drag exerted by the belt 82 on drum 44 will be reduced to proportionally offset the greater weight remaining on the enlargement 68*a*.

The third groove 44*c* of drum 44 accommodates another inextensible belt 92, one end of which is secured to an eye 94 projecting up from the frame transverse strap 10*j* and the other end of which is connected to an eye 96 on a lever arm 98 whose upper end is connected by a pivot 102 to the frame strap 10*j*. The lever 98 extends down below the teeterboard enlargement 68*a* and its lower end is connected by a flexible chain 106 to the lower end of rod 40, the rod extending below enlargement 68*a* through a clearance hole 107 therein.

It will be seen from the foregoing that when the accumulator dancer 32 is in its maximum storage position, at which there is a maximum amount of rope stored in accumulator 26, the lever arm 98 will exert a maximum amount of tension on the belt 92 so that the belt exerts maximum drag on the drum 44. On the other hand, when the dancer 32 is raised because there is sufficient force applied to the rope segment 22*a*, lever arm 98 swings upwardly thereby reducing the tension on belt 92. As the dancer 32 rises and tension is reduced on belt 92, the dancer 32 eventually reaches an equilibrium position and rises no farther, even if additional force is applied. Such additional force may cause the rope 22 to circulate faster through the apparatus.

Preferably, the exercise apparatus is arranged so that the drum 44 will not turn unless the user, by pulling on rope segment 22*a*, raises the dancer 32 enough to swing lever arm 98 up so as to reduce the tension on belt 92. Since the accumulator 26 forms a pulley system with a mechanical advantage of two, this means that the user must exert a downward force on the rope segment 22*a* that is at least one-half the vertical load on the dancer 32, i.e. the force exerted by the weights 38 connected to the dancer. So long as the user exerts this requisite pulling force on the rope segment 22*a*, belt 92 will exert minimal drag on drum 44 enabling the drum to rotate and replenish the accumulator 26 with rope. The rate at which the moving drum will be turned by the pulling force depends on the drag exerted on the drum by the belt 82. That depends, in turn, on the amount of weight which is lifted when the user pulls down on the rope segment 22*a* in order to raise the dancer as aforesaid, or more accurately, the amount of weight not lifted and which, therefore, remains on the teeterboard.

If, for example, only the topmost weight 38 is connected to the dancer 32, only a small pulling force on the rope will be required to raise the dancer 32 enough to untension belt 92 and permit rotation of the drum 42. Since the rest of the weights 38 remain on the teeterboard, the drag exerted on the drum by belt 82 will be a minimum. Resultantly, the user's arm and back muscles are subjected to substantially constant dynamic tension, albeit of a relatively small magnitude because, in this example, he is only lifting the topmost weight 38 in the apparatus. In other words, with only a single weight 38 being connected to the dancer, the user exerts only a small pulling force on the rope.

The degree of difficulty can be increased by force-loading the dancer 32 with a greater number of the weights 38. This means that when the user pulls down on the rope segment 22*a*, he will have to exert more force in order to lift the dancer 32 enough to untension belt 92 so that drum 44 can rotate. In addition, since fewer weights 38 remain on the teeterboard enlargement 68*a* to offset the pulling action thereon by spring 76 he must exert additional pulling force on the rope segment 22*a* in order to raise the dancer 32 from its maximum storage position. The user must pull down on the rope with a greater force than in the first example because of the additional number of weights 38.

As will be seen from the foregoing, my exercise apparatus provides an effective and efficient way for one to exercise the arm and back muscles in the same way as would occur if the user were actually climbing a rope. By using the appropriate number and sizes of weights 38, my exercise apparatus can even enable a user to pull down rope segment 22*a* hand-over-hand with a force equal to his own weight or even more as he would have to do if he were hoisting himself up on a rope. Preferably to do this, he would secure himself to seat 14 using seat belt 16. In addition, my apparatus allows a user to exercise exerting a force less than his body weight by simple adjustment of the weights 38.

It should also be appreciated that the apparatus is quite compact so that it only occupies a small amount of floor space in an exercise room, health club or the like. Also, since it is made up of a relatively small number of relatively inexpensive rugged parts, the apparatus should have a long useful life.

It will thus be seen that the objects set forth above, among those made apparent from the preceding description, are efficiently attained. Also, certain changes may be made in the above construction without departing from the scope of the invention. For example, the various components of the apparatus may be rearranged so that the rope segment 22*a* is oriented horizontally enabling the person exercising to pull on the rope horizontally as he would do if he were engaging in a game of tug-of-war. Therefore, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. Rope climbing apparatus comprising:

A. support means;

B. a length of rope;

C. a rope accumulator supported by said support means, said accumulator storing a variable length said rope and including 1) a trolley, and 2) biasing means for biasing said trolley to a maximum storage position;

D. means on the support means for presenting a segment of said rope to a user of the apparatus so that said user can draw rope from the accumulator; and E. variable drag means supported by said support means and for feeding said rope pulled by the user back to said accumulator to replenish the said accumulator with rope, said drag means including 1) means for inhibiting the feeding of rope to said accumulator unless said segment of rope is pulled with a force sufficient to overcome the biasing on said accumulator trolley and move said trolley from its maximum storage position, and 2) means for controlling the rate at which said rope is fed to said accumulator in accordance with the magnitude of said accumulator trolley biasing.

2. The apparatus defined in claim 1 wherein said rope is arranged in an endless loop.

3. The apparatus defined in claim 2 wherein said rope is oriented in a generally vertical plane.

4. The apparatus defined in claim 1 wherein

A. the accumulator includes 1) at least two fixed pulleys rotatively mounted to the support means, 2) at least one pulley rotatively mounted to said trolley below the fixed pulleys and movable with said trolley toward and away from said fixed pulleys, and 3) said rope is looped between said fixed pulleys and said trolley pulley, and B. said biasing means includes weight means connected to said trolley and which may be raised with said trolley when the user pulls on said segment of rope.

5. The apparatus defined in claim 4 wherein said weight means include a stack of individual weights which can be selectively locked together.

6. The apparatus defined in claim 5 wherein each of said individual weights weighs approximately the same amount.

7. The apparatus defined in claim 1 wherein the variable drag means include a drum rotatively mounted to the support means and around which said rope is engaged so that said rope is fed to said accumulator at a rate determined by the rotational speed of said drum.

8. The apparatus defined in claim 7 wherein the inhibiting means includes a speed controlling means for controlling the rotational speed of said drum in accordance with the position of said accumulator trolley.

9. The apparatus defined in claim 8 wherein said speed controlling means includes A. a strap engaged around said drum;

B. a means for connecting one end of said strap to said support means, and

C. a means for linking the opposite end of said strap to said dancer so that 2) when said trolley is in its maximum storage position, said strap is tensioned a maximum amount so as to exert maximum drag on said drum, and 2) when said trolley is moved away from its maximum storage position, the tension on said strap is reduced so that said strap exerts less drag on said drum allowing said drum to rotate.

10. The apparatus defined in claim 9 wherein the speed controlling means includes A. a second strap engaged around said drum, and B. means for varying the tension on said second strap in accordance with the amount of biasing on said accumulator trolley.

* * * * *